United States Patent [19]

Einer

[11] Patent Number: 5,002,203

[45] Date of Patent: Mar. 26, 1991

[54] TANK WITH ENTRY FITTING

[75] Inventor: Richard R. Einer, Escondido, Calif.

[73] Assignee: Palomar Mountain Spring Water and Ice, Escondido, Calif.

[21] Appl. No.: 364,817

[22] Filed: Jun. 12, 1989

[51] Int. Cl.[5] ..... B65D 35/28

[52] U.S. Cl. ..... 222/95; 222/386.5; 222/389; 220/404

[58] Field of Search ..... 220/402–404; 222/386.5, 389, 131, 95, 105, 94

[56] References Cited

U.S. PATENT DOCUMENTS

| | | | |
|---|---|---|---|
| 3,468,451 | 9/1969 | Coleman | 220/404 X |
| 3,876,115 | 4/1975 | Venus, Jr. et al. | 222/183 |
| 3,933,263 | 1/1976 | Frew et al. | 220/404 X |
| 4,098,434 | 7/1978 | Uhlig | 222/94 |
| 4,585,143 | 4/1986 | Fremow et al. | 220/462 |

FOREIGN PATENT DOCUMENTS

| | | | |
|---|---|---|---|
| 994395 | 11/1951 | France | 222/386.5 |

*Primary Examiner*—Michael S. Huppert
*Attorney, Agent, or Firm*—Henry G. Kohlmann

[57] ABSTRACT

This invention relates generally to the fluid of water tanks. More specifically this invention relates to water tank structure and quick change fittings for tanks which are adapted for the storage and dispensing of drinking water although any liquid could be used. The instant invention is a tank structure and fitting which permits the use of a pump or compressed gas to force the liquid out of the tank by the compression of a bladder within the tank which causes the liquid to be dispensed out of the tank when the bladder is collapsed. The fitting is sufficiently wide to facilitate the insertion, support and removal of the bladder or multiple bladders into and out of the tank. The fitting further permits the use of an inner flexible bag which is insertable into the bladder and allows the entire tank to be easily sterilized by simple removal and replacement of the inner bag without the necessity of removal of the bladder itself.

12 Claims, 2 Drawing Sheets

TANK WITH ENTRY FITTING

FIELD OF THE INVENTION

The field of this invention relates generally to holding tanks adapted for the holding of a liquid without contamination and fittings which permit rapid access to the interior of the tank. More specifically this invention relates to a holding tank structure and fitting adapted for the insertion, support and removal of internal elements within the water storage tank without the necessity of dismantling the storage tank itself. Further this invention also relates to the specific structure of a water storage tank which will permit the dispensing of water from the tank and which permits the sterilization of the water tank on site without the removal or dismantling thereof and without the use of chemicals.

Many devices exist for the dispensing of water from tanks. These devices generally fall into three categories. The first is the dispensing of water from giant off site tanks located in towers or on hills in the area by the use of gravity. These are usually very large tanks used by municipalities and often the water is sterilized by the addition of some antiseptic or sterilization chemical or where the turnover of the water is so rapid or continuous that harmful or undesirable effects or contamination do not occur. However, when special types of water, such as filtered, sterilized, flavored, distilled, or mountain spring water, are desired they are usually provided by private commercial enterprises by either dispensing the same in small containers, i.e. five gallons or less which are regularly replaced or by large tanks, sometimes 60 gallons or more, stored on site which require pumps to dispense the water to the site. These latter devices are the focus of the instant invention. First, the pumps used to dispense the water from the tanks have a high rate of failure and often the parts used to construct the pumps add an undesirable and often offending taste to the water particularly when the water has not been moved for a period of time and has remained continuously in contact with the pump diaphragm and other pump parts. In addition often the tank itself must be flushed for several hours or constructed of special materials to avoid imparting an undesirable and often offending taste to the contents. Often, particularly at home and office sites gravity feed is usually impractical on site because the water stored is usually at nearly the same level as its destination for use. Therefore, the head sufficient for water flow must be established by alternative means sufficient to cause such water flow.

Accordingly, the instant invention also uses a compressed gas to dispense the water from the tank. Use of a compressed gas has been known for some time and is used to dispense many beverages such as beer and even soft drinks. Some beer kegs even use an inner bladder to separate the beer from the gas and dispense the same by collapsing the inner lining of the keg and force the beer out of the keg under pressure. However, in these prior art inventions the tanks or kegs as the case may be must be removed from the site in order to sterilize the containers from time to time or face the risk of contamination if refilling on site is attempted. The instant invention not only provides an effective means for dispensing water or any other liquid for that matter by the use of pumps or a compressed gas but also permits the on site sterilization of the tank with ease and without the necessity of the use of antiseptic or other sterilization chemicals, heat or other means which may have an effect on the taste of the water or which may be cumbersome or dangerous to use as well as eliminating any flushing requirement for the container.

DESCRIPTION OF THE PREFERRED EMBODIMENT

Figure 1:
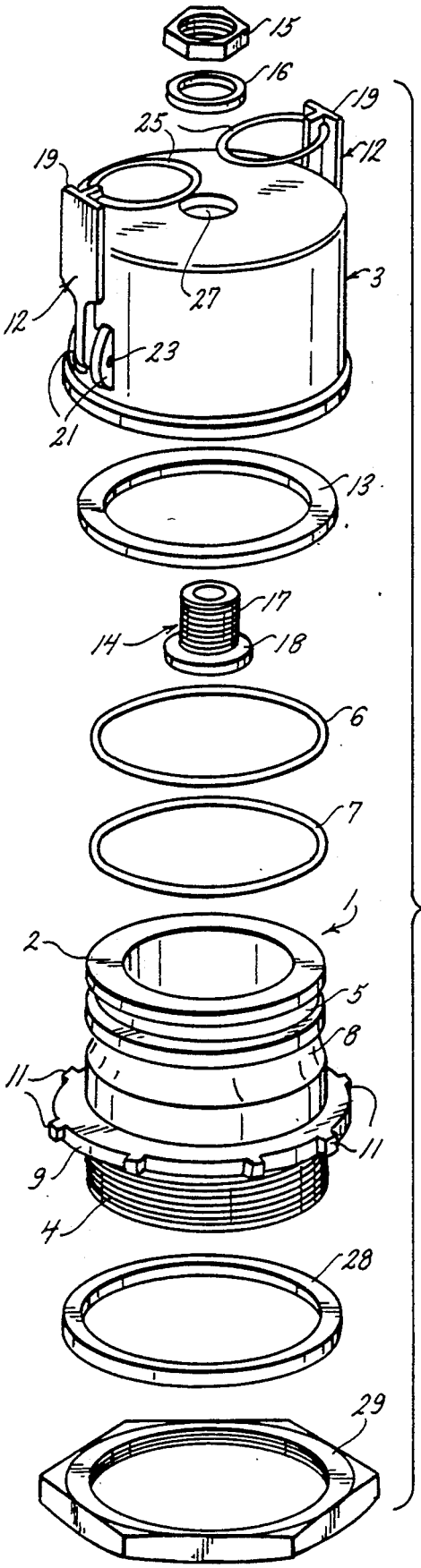
FIG. 1 is an exploded view of the cap and tank fitting illustrating the various parts thereof.
Figure 5:
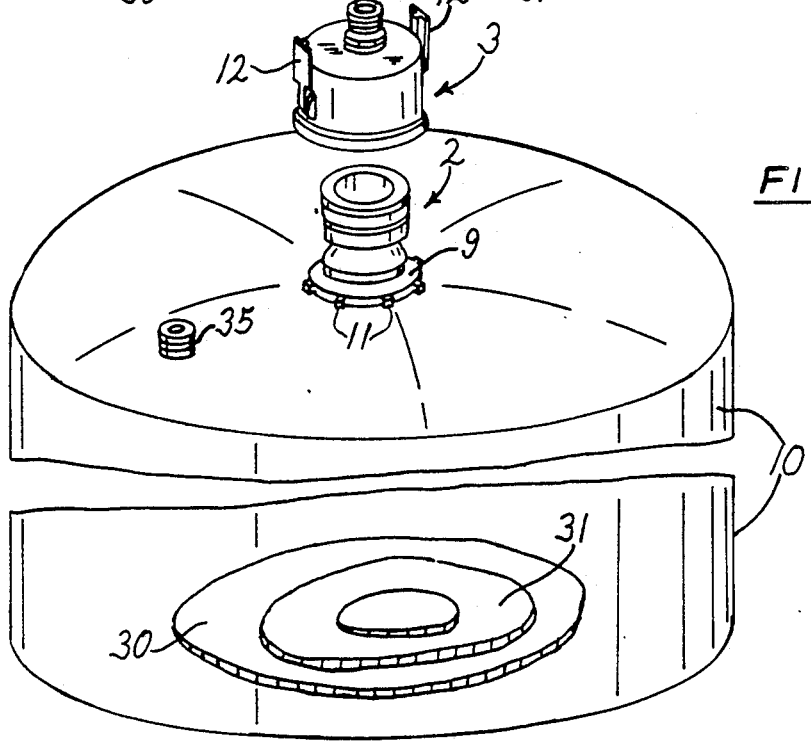
FIG. 5 is a view of the fitting attached to the tank and a partial sectional view of the tank showing the bladder and inner lining structure.

With reference to the drawings, FIG. 1 illustrates the cap and tank fitting structure in detail. The essence of the invention is to provide a sealed tank which permits entry through the tank fitting 1, having two major portions comprising a cap 3 which attaches to a male member 2 which may be screwed into the top of a tank 10, as shown in FIG. 5 or which may be made integral or otherwise fastened to the tank by means of an internal nut 29 and a sealing washer 28 or other device well known in the art depending, of course on the manner of construction of the tank 10. The preferred embodiment of tank 10 is in the form of a hollow cylindrical vessel having a concave bottom and a convex top.

The male member 2 of the tank fitting 1 is a hollow elongated cylinder having screw threads 4 on one end and at least one annular recess 5 at the other. The annular recess 5 is in the form of a generally rectangular groove about the circumference of male member 2 and near the thereof which is adapted for receiving two circular grommets 6 and 7. It is, however, contemplated by this invention that one such grommet would suffice for operation of the invention. In the preferred embodiment male member 2 has a second annular recess 8 which is in the form of a partially cylindrical channel about the circumference of male member 2 between the first recess 5 and the end 4 which has the screw threads. This annular recess 8 is adapted for receiving locking handles 12 to enable cap 3 to lock onto male member 2 although any suitable locking means can be used. Finally, a means for permitting the fitting to be gripped for screwing into the top of the tank is integral with the cylinder of male member 2 in the form of an annular ring 9 having a plurality of teeth 11. It should be noted that the male member 2 of the fitting 1 may be made integral with the tank and is adapted to function identical to the threaded mode described above.

FIG. 1 also illustrates the structure of the cap 3 having two locking handles 12 and a washer 13. Said cap 3 has a circular hole 27 in the top thereof adapted for receiving a hollow cylindrical fitting 14. Said fitting 14 has an annular flange 18 on one end and screw threads 17 on the other for receiving a nut 15 and a sealing washer 16. Said fitting 14 is fastened to the cap 3 by inserting said fitting into hole 27 and screwing nut 15 thereon after placing a washer 16 between said cap 3 and said nut 15.

Figure 2:
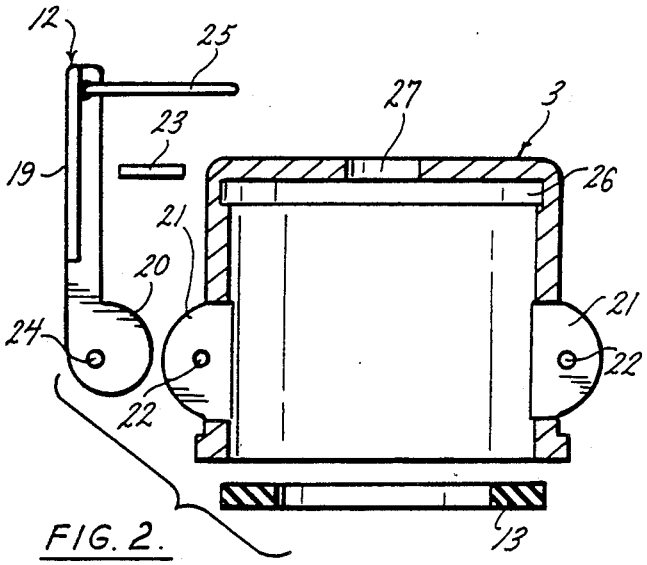
FIG. 2 is a sectional view of the cap and washer and one locking handle.

The locking handles 12 are adapted for insertion into the recess 8 so as to lock the cap 3 into juxtaposition with male member 2. Said locking handles 12 as illustrated in FIG. 2 have an elongated portion 19 for gripping to manipulate said handles 12 and a cam portion 20 for engaging said recess 8. It should be noted that while there are two such handles as shown in FIG. 1 only one such handle is shown in FIG. 2 for simplification. Said locking handles are rotatably attached to flanges 21 which are integral with the cap 3 and which have holes 22 for receiving a pin 23. The handles 12 each have a corresponding hole 24 also for receiving pin 23. The holes in the handles 12, however, are offset from the center of the radius of the arc which forms the cam portion to permit the cam portion to tilt outwardly and away from recess 8 and allow disengagement of the male member 2 and the cap 3 when the handles are manipulated downward. Conversely, when the handles are manipulated upward the cam 20 of the handles 12 is placed into frictional engagement with recess 8. The shape of the arc of the cam 20 is made such that a slightly lessor degree of friction is encountered when the handles are in a fully upright position. This facilitates maintaining the handles 12 in an upright locked position. Alternatively, handles 12 can be adapted for receiving rings 25 in the ends thereof opposite cam 20 which may be locked together by means of a padlock or other prior art locking mechanism to prevent unintended disengagement.

FIG. 2 further illustrates the internal structure of cap of cap 3 which includes an annular recess 26 adapted to receive the circular washer 13 and the hole 27 in the top of said cap of said cap 3.

Figure 3:
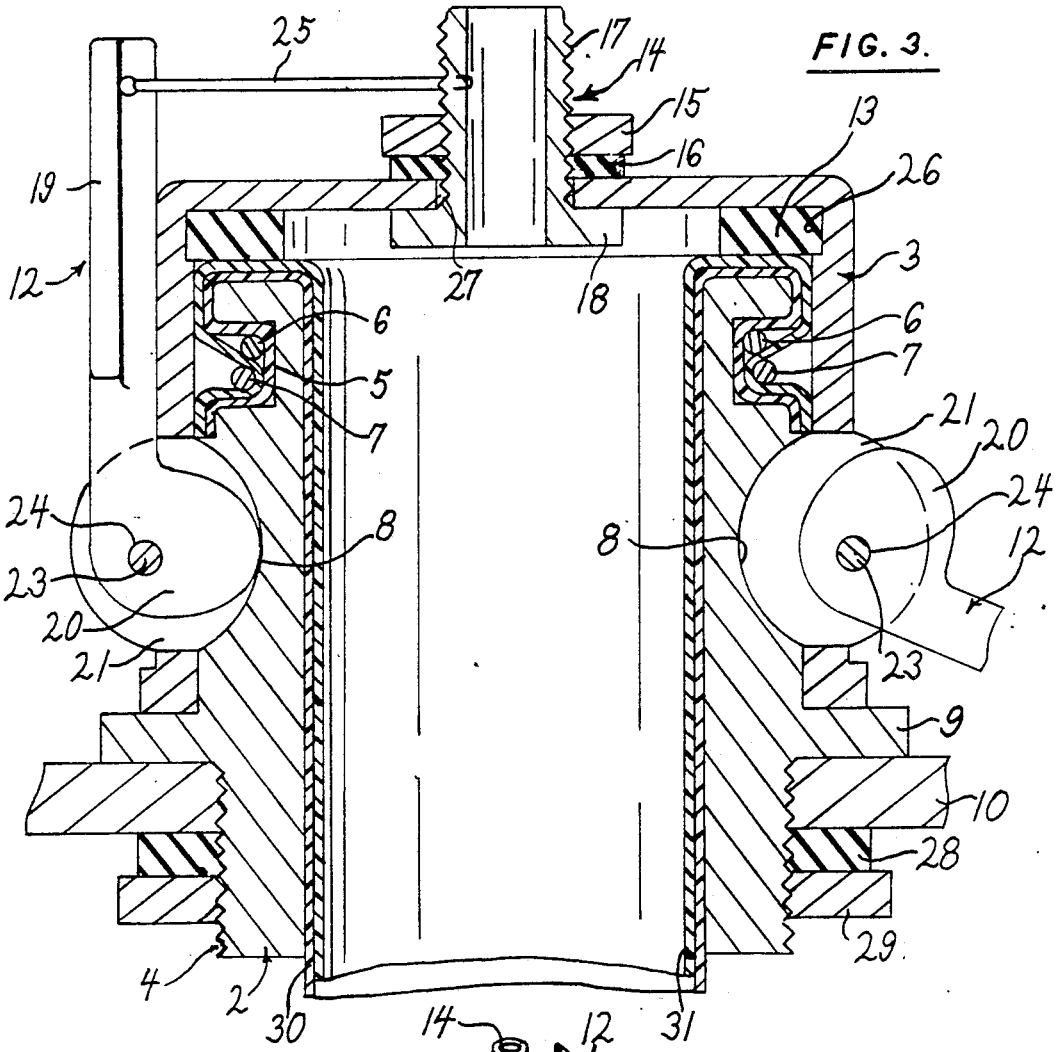
FIG. 3 is a sectional view of the cap and tank fitting locked together with the bladders and inner lining in place.

FIG. 3 illustrates the cap 3 in juxtaposition with male member 2 and one of the locking handles 12 in an upright locked position and the other in the unlocked position. Further, the male member 2 is fastened to the tank 10 by screw threads and optional nut 29 and an optional washer 28. Between, said cap 3 and male member 2 are a bladder 30 and an inner lining or bag 31 although for the purposes of this invention one bladder or lining can suffice. The bladder 30 is first inserted into the tank 10 and is of sufficient strength to withstand the gas pressure which is introduced between the inner wall of tank 10 and the bladder 30. The inner lining 31 is inserted into the bladder 30 and contains and is impervious to the liquid in the tank 10. The gas pressure applied causes the bladder 30 to collapse and forces the contents of the inner lining 31 out through the fitting 14 inserted into the hole 27 of cap 3. Maintenance of the inner lining 31 is facilitated by a sufficiently wide opening in the cylindrical portion of male member 2 to permit the introduction and withdrawal of the bladder 30. The bladder 30 must be flexible and sufficiently strong to withstand the pressure of the gas without rupture. This is governed primarily by the force of the pressure and the type and thickness of the materials used to fabricate the bladder 30. In this particular embodiment the bladder 30 is made of a flexible plastic material of a thickness of approximately 30 mills. Rubber could also be used.

Alternatively the length of the necks of the opening of bladder 30 and the inner lining 31 may be extended to permit the cams 20 of the locking handles to grip the bladder 30 and the inner lining 31 with a compressive force at the annular grove providing additional frictional force for the locking handles and providing a tighter seal between the cap 3 and the inner lining 31.

Sterilization of the tank, therefore, may be performed on site simply by the removal of the inner lining 31 and replacement at the site. The lining removed may be returned to the plant for sterilization or the lining 31 may be discarded entirely. In the event the bladder 30 is the only lining used in the tank 10, the cost thereof usually requires that expensive sterilization is required to return the same to service due to the expense inherent in the use of a lining with the thickness and necessary strength required of a single inner lining. The inner lining 31, however, eliminates the need to remove bladder 30 at all. The inner lining 31 is inserted into the bladder 30 and may be made of light weight plastic, rubber or other flexible waterproof material. Its outer dimensions are ideally the same as or slightly larger than the inner dimensions of the bladder 30. It should be noted that slight pressure between the walls of the tank 10 and the lining 31 will cause compression of the bladder 30 to the size of inner lining 31 even if the inner lining 31 is slightly smaller although this should be avoided as inner lining 31 may burst prior to compression of bladder 30. The bladder 30 may be made of such materials and strength as may be necessary to withstand the pressure of the gas which forces the water, or other liquid for that matter, out of the bladder 30 and the inner lining 31 while the bladder 30 need only prevent leakage. When the container is emptied the inner lining 31 may be removed, discarded and replaced with another inner lining 31 which is new and sterile. The need and associated efforts to sterilize the bladder 30 or inner lining 31 have been avoided and the efforts and the expense associated therewith is therefore unnecessary.

The structure of the fitting 1 thus far described facilitates the use of one bladder 30 or a bladder 30 and an inner lining 31. FIG. 3 illustrates the manner in which the bladder 30 and the inner lining 31 are attached to the male member 2 of fitting 1. A rubber grommet 6 engages the top of the bladder 30 about the upper end of the male member 2 and securely holds the bladder 30 in place at the recess 5. The inner lining 31 overlaps the bladder 30 and a second rubber grommet 7 engages the top of the inner lining 31 about the upper end of male member 2 and securely holds the inner lining 31 in place at the recess 5. When maintenance is required the second grommet 7 may be removed which permits removal of the inner lining 31 and replacement thereof without disturbing the bladder 30. The use of a separate recess 5 for each grommet is contemplated to be within the scope of this invention.

The invention of course may be practiced with one grommet to secure both the bladder 30 and inner lining 31 but care would be required to avoid allowing the bladder 30 to fall into the interior of the tank 10 when removing or installing inner lining 31. In addition to the grommets 6 and 7 the locking handles 12 also may grip the tops of both the bladder 30 and inner linings 31 and provide alternative security means for holding said bladder 30 and said inner lining 31 in place. When the locking handles 12 are placed into an upright locked position, the cap 3 is securely and firmly held in place and washer 26 is engaged in an air tight seal against the top of the male portion 2 of fitting 1 and the bladder 30 and inner linings 31 thereby sealing the entire unit.

Figure 4:
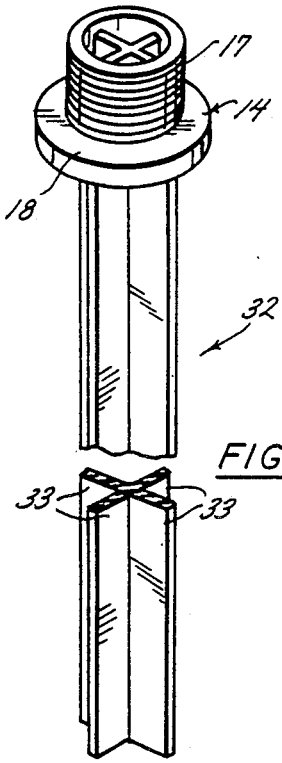
FIG. 4 is an perspective view of the cap water exit fitting and an optional bag collapse control vane.

FIG. 4 illustrates an anti-collapse attachment 32 adapted for insertion into the screw head 14. This attachment 32 comprises an elongated member having a plurality of vanes 33 extending outwardly from the center thereof. The elongated member 32 is adapted for insertion into the inner diameter of screw head 14 and ideally may be held in place by frictional engagement with the inner diameter of screw head 14 although this is not absolutely necessary and attachment 32 alternatively may be constructed of materials which would permit it to float in place or of sufficient length that engagement with the bottom of the tank 10 will hold it in place.

The elongated member 32 serves to prevent uneven collapse of the bladder 30 and inner lining 31 when partially empty thereby preventing the trapping of fluid in any particular corner or pocket of the linings.

The tank 10, as illustrated in FIG. 5, will be fitted with a compressed gas system known in the art such that the gas can be introduced through at least one inlet 35 which permits the gas to enter between the inner wall of the tank 10 and the outer wall of the bladder 30. The pressure introduced should be regulated so that a constant pressure is maintained in the tank. When the fluid is permitted to exit the tank 10 through fitting 14 such as by opening of a valve or faucet connected to the outlet of fitting 14 the fluid will be forced out by the gas pressure. The tank 10 should also be fitted with a gas relief valve and pressure gage as is well known in the art. When change of the bladder 30 or inner lining 31 is desired the gas may be shut off by a valve at the inlet 35 and the remaining gas exhausted in a reverse direction through inlet 35, the relief valve or a separate outlet may be installed on the tank. Gas may be reintroduced through inlet 35 after the inner lining 31 is replaced or more fluid is added. This preferred embodiment uses carbonic gas as the ideal gas to be used to pressurize the tank 10.

Other structure may be utilized to implement the invention the best mode of which is described by the applicant in the preferred embodiment above and such other structure is contemplated to be within the scope of this invention.

Having thus described the invention, what is claimed is:

1. A tank adapted for receiving a liquid which further comprises:

a. a tank body;

b. at least one fitting attached to said tank body and communicating with the interior of said tank having alternatively an open state for permitting the introduction of said liquid into said tank and a closed state for permitting said liquid to be removed from said tank;

c. an inlet attached to said tank body communicating with the interior of said tank between the body of said tank and the inner container for introduction of a compressed gas;

d. an first inner container adapted for changing its volume having an opening at one end received inside said tank and of sufficient strength to support said liquid without rupture removably attached to said fitting; and e. a second inner container impermeable to said liquid, adapted for changing its volume, having an opening at one end thereof, insertable into said first container, removably attached to said fitting; whereby introduction of the compressed gas, of sufficient pressure to compress said inner containers, into said tank and between said inner container and said tank body causes said inner containers to reduce volume and expel said liquid from said tank.

2. A tank as described in claim 1 wherein said fitting further comprises:

a. a hollow cylinder having at least one annular recess at one end and a means for attachment to said tank at the other.

3. A tank as described in claim 2 wherein said fitting further comprises:

a. a means for opening and closing said fitting removably attached to said fitting.

4. A tank as described in claim 3 wherein said means for opening and closing said fitting further comprises:

a. a cap having locking means attached thereto; and b. at least one receptacle at one end of said cylinder for receiving said locking means.

5. A tank as described in claim 2 which further comprises:

a. means for removably binding said first and second inner linings to said fitting at said recess.

6. A tank as described in claim 5 wherein said binding means comprises:

a. at least one elastic grommet of a diameter smaller than the outside diameter of the cylinder.

7. A tank adapted for holding a liquid which further comprises:

a. a first inner container having at least one opening therein, received inside said tank and removably attached to said tank;

b. a second inner container, removably attached to said tank, impervious to said liquid having at least one opening therein insertable into said first container;

c. a fitting through which the liquid may be introduced into said second inner container, attached to said tank, said fitting having alternatively an open state for introduction of said liquid and a closed state for expelling said liquid, one end of said fitting having means for removable connecting the opening of said second inner container to said fitting;

d. a means for changing the state of said fitting; and e. an inlet attached to said tank, communicating with the interior of said tank between the body of said tank and the inner container for introduction of a compressed gas.

8. A tank as described in claim 7 wherein said fitting comprises:

a hollow cylinder having at least one annular recess at one end and a means for attachment to said tank at the other.

9. A tank as described in claims 8 wherein said fitting further comprises:

a. a means for changing the state of said fitting.

10. A tank adapted for holding a liquid which further comprises:

a. a first inner container having at least one opening therein, received inside said tank;

b. a second inner container impervious to said liquid having at least one opening therein, insertable into said first container;

c. a fitting comprising a hollow cylinder having a first annular recess at one end for removably connecting the opening of said second inner container to said fitting and attached to said tank at the other, through which the liquid may be introduced into said second inner container;

d. a cap having locking means attached thereto, removably attached to said fitting;

e. a second annular recess at one end of said fitting adapted for receiving said locking means; and f. an inlet communicating with the interior of said tank between the body of said tank and the first inner container for introducing a compressed gas.

11. A tank for holding a liquid which further comprises:

a. a tank body;

b. means for introducing a compressed gas into said tank body;

c. a first inner container of sufficient thickness to support the liquid under stress of said compressed gas without rupture;

d. a second inner container insertable into said first inner container adapted for receiving and holding the liquid;

e. a fitting through which the liquid may be introduced into said second inner container attached to said tank body said fitting having a means for permitting the attachment of the opening of said second inner container to said fitting; and f. a means for opening and closing said fitting.

12. A walled tank which comprises:

a. a tank body having at least one opening;

b. a first container adapted for holding a liquid having an opening at one end thereof disposed in said tank such that the opening of said container extends out of the opening of said tank;

c. a second container adapted for changing its volume and having an opening at one end, insertable into said first container for receiving the liquid;

d. a means for introducing a compressed gas between said first container and the walls of said tank;

e. a fitting through which the liquid may be introduced into said second container attached to said tank, said fitting having a means for attachment of the opening of said first container and means for permitting the attachment of the opening of said second container to said fitting; and f. a means for opening and covering said fitting.

* * * * *